United States Patent [19]

Loepfe et al.

[11] 4,359,068

[45] Nov. 16, 1982

[54] ELECTRONIC WEFT STOP MOTION ON A GRIPPER SHUTTLE WEAVING MACHINE

[75] Inventors: Erich Loepfe, Pfaffhausen; Erich Weidmann; Walter Schümperli, both of Wetzikon, all of Switzerland

[73] Assignee: Loepfe Brothers Limited, Wetzikon, Switzerland

[21] Appl. No.: 144,231

[22] Filed: Apr. 28, 1980

[30] Foreign Application Priority Data

May 4, 1979 [CH] Switzerland ..... 4188/79

[51] Int. Cl.[3] ..... D03D 51/34

[52] U.S. Cl. ..... 139/370.2; 137/450; 66/163

[58] Field of Search ..... 139/336, 370.1, 370.2, 139/450; 340/675, 677; 66/163; 250/571, 572; 324/72, 76 R

[56] References Cited

U.S. PATENT DOCUMENTS

| | | | |
|---|---|---|---|
| 3,833,026 | 9/1974 | Domig | 139/370.2 |
| 4,051,871 | 10/1977 | Vella | 139/370.2 |
| 4,228,828 | 10/1980 | Loepfe et al. | 139/370.2 |

*Primary Examiner*—Henry Jaudon

*Attorney, Agent, or Firm*—Werner W. Kleeman

[57] ABSTRACT

The electronic weft stop motion is designed for monitoring the weft thread in a last phase immediately following the weft insertion into the weaving shed when a thread tensioning device located on the picking side of the machine laterally deflects the weft or filling thread and thus holds it tensioned. A tactile thread sensor is arranged in the region of the lateral deflection of the weft thread in such a manner that the thread sensor goes free from the weft thread in the undeflected condition thereof, however is frictionally contacted by the weft thread when the latter is being laterally deflected.

4 Claims, 8 Drawing Figures

ELECTRONIC WEFT STOP MOTION ON A GRIPPER SHUTTLE WEAVING MACHINE

BACKGROUND OF THE INVENTION

The present invention relates to a novel electronic weft stop motion on a gripper shuttle weaving machine provided with a shuttle picking device, shuttle catching means including shuttle braking and resetting means, and thread tensioning means in advance of the shuttle picking device for laterally deflecting the weft yarn during the action of the shuttle resetting means.

A gripper shuttle weaving machine and weft stop motions fitted thereto are described in German patent publication No. 1,535,615. Weaving machines of this type are generally known and in widespread use. Essential for the function of the weft stop motion or weft thread monitor in this case is the cooperation of the elements effecting the weft insertion, in particular the gripper shuttle or projectile, a thread brake located on the picking side and a subsequently arranged thread tensioner. This weft thread monitor responds to the so-called pull-after motion of the weft thread which occurs in the last phase of the lateral deflection thereof: when the weft thread inserted in the weaving shed has been tensioned, a small thread end is pulled through the thread brake in a direction from the supply spool of the weaving machine. According to a preferred embodiment, a roller is provided as thread feeler and arranged in the region of lateral deflection. Rotation of the roller is sensed and indicated by an optoelectrical sensor. The roller comes into contact with the weft thread only upon lateral deflection thereof without at first being set into rotation. After that the roller is rotated when the pull-after movement begins, and the sensor responds and produces a signal indicative of an intact weft thread. A particular trigger device controlled by the weaving machine delimits the response of the weft thread monitor to a time interval defined by the pull-after motion. Absence of the sensor signal within this time interval causes the weaving machine to stop.

With this known weft stop motion, the late monitoring when the weft thread has already been inserted is advantageous since disturbances, such as thread breaks, which do not seldomly occur in the last phase of the weft insertion are detected. On the other hand, a very small time interval is available for the timely or correct stopping of the weaving machine, and the inertia of the roller feeler is detrimental in this respect. Moreover, the pull-after motion may fail to appear even with an intact or correctly inserted weft thread; in this event the weft thread monitor causes an unwanted or faulty stop of the weaving machine.

SUMMARY OF THE INVENTION

It is a primary object of the invention to provide for a novel and improved electronic weft thread monitor or stop motion which reliably responds to the intact weft thread which is being laterally deflected by the thread tensioning device of a gripper shuttle weaving machine.

It is a further objective of the invention to provide an electronic weft stop motion which responds to yarn breaks occurring in a late phase after weft insertion, immediately and without any delay as caused by inertia of mechanical elements.

These and other objects which will be apparent as the description proceeds may be realized by the inventive electronic weft stop motion, which comprises tactile or contact-type thread sensing means located in the region of the lateral deflection of the weft yarn such as to be frictionally contacted by the tensioned weft yarn only upon such lateral deflection for furnishing an electrical thread sensing signal indicative of correct weft insertion.

BRIEF DESCRIPTION OF THE DRAWINGS

The invention will be better understood upon consideration of the following detailed description thereof which makes reference to the annexed drawings wherein.

DETAILED DESCRIPTION OF THE INVENTION

In the following detailed description, the inventive electronic weft stop motion or weft thread monitor is termed "tensioning phase monitor", in view of the peculiar operation thereof and in distinction from the conventional weft thread monitors.

Figure 1:
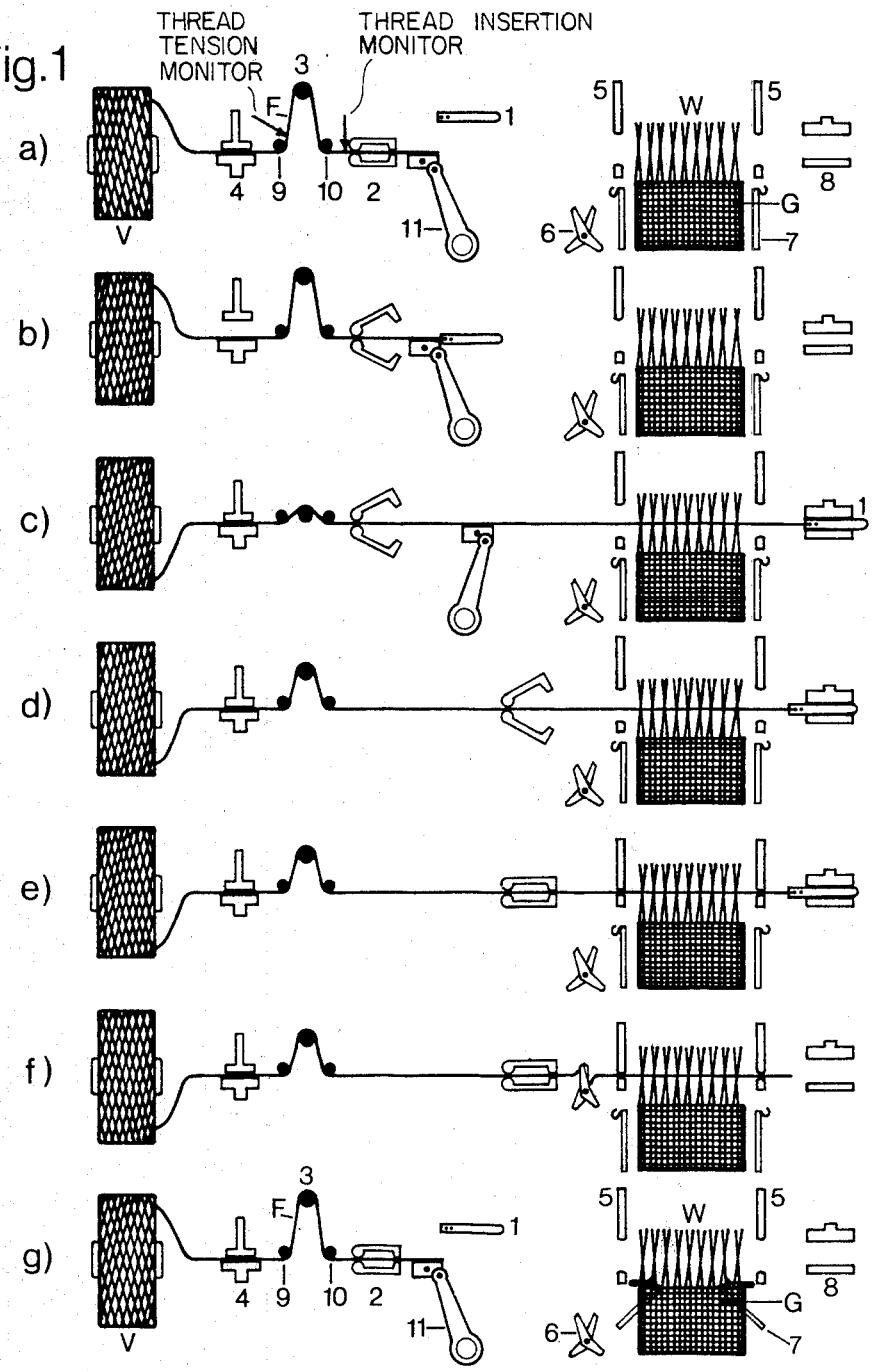
FIG. 1 illustrates the operation of weft insertion controlling components of a projectile weaving machine during a working cycle thereof.

FIG. 1 demonstrates some distinct phases in the working cycle of the weaving machine. The various positions of the thread tensioner 3 and the paths of the weft thread F between the thread guide eyes or eyelets 9 and 10 are of importance to the function of the thread sensing devices described in the following. In FIG. 1, there are further shown a stationary supply spool V, thread brake 4, thread feeder 2, picking lever 11 of the picking mechanism, projectile or gripper shuttle 1, two selvedge thread clips 5, scissors or cutter means 6, two selvedge pins 7, shuttle brake 8 of the catching unit, weaving shed W and cloth or fabric G.

FIG. 1 shows at (a) through (g) the following phases or positions of the movable components of the weaving machine:

(a) The projectile 1 is placed in its picking position. The thread tensioner 3 occupies the upper or idle position.

(b) The thread feeder 2 releases the weft thread end which the projectile 1 has taken over therefrom.

(c) The projectile 1 conveys the thread through the weaving shed W, and the thread tensioner 3 and the controllable thread brake 4 function such that the thread F which is being inserted is loaded or stressed as little as possible. During insertion of the weft thread, the thread tensioner 3 occupies the low position thereof.

(d) The projectile 1 is braked by the shuttle brake 8 in the catching unit and then reset to its fixed thread releasing position, while the thread tensioner 3 deflects the weft thread F and thus holds it tensioned. At the same time, the thread feeder 2 proceeds near to the selvedge of the cloth or fabric G. During the tensioning or deflecting operation the weft thread undergoes the above mentioned pull-after motion.

(e) The thread feeder 2 grips the weft thread F, whereas the two selvedge thread clips 5 clamp the same on both sides of the cloth or fabric G.

(f) The thread F on the picking side is severed by the cutter means or scissors 6, and is released from the projectile 1 on the catching side. A conveyor mechanism (not shown) takes over the projectile 1 and brings it back to the picking mechanism along a path outside the weaving shed.

(g) The reed has beaten-up the inserted weft thread. The selvedge pins 7 place the weft ends into the following weaving shed to form a laid-in selvedge. The thread tensioner 3, moving to the upper position, has taken-up the thread length set free by the thread feeder 2 returning to its starting position. The next projectile 1 is brought into its picking position.

Now with reference to FIG. 1 there will be explained in which phase of the working cycle of the weaving machine or loom the weft thread is monitored at the region of the thread tensioner 3. First, the weft thread F is not sensed or monitored in the upper or idle position of the thread tensioner 3 as shown in FIG. 1(*a*) and 1(*b*). Between the positions shown in FIGS. 1(*b*) and 1(*c*) the projectile 1 is picked and the weft threads F inserted into the weaving shed W. No monitoring takes place also in this phase. According to FIG. 1(*c*) the projectile 1 occupies its braked position and in FIG. 1(*d*) its reset position within the shuttle brake 8. It is obvious that the thread tensioner 3 returns—between the positions according to FIGS. 1(*c*) and 1(*d*)—from the lowered position to a position intermediate the lowered and upper positions. In the time interval between the positions of FIGS. 1(*c*) and 1(*d*) the inventive tensioning phase monitor scans and monitors the weft thread tensioned by lateral deflection, as still will be described with reference to FIG. 2. In the further course of the working cycle, in the positions shown in FIGS. 1(*e*) through 1(*g*), the weft thread is not scanned at the region of thread tensioner 3.

With reference to the positions or phases of the action of the thread tensioner 3, there should be noted that with the working weaving machine the positions shown in FIG. 1 at (d), (e) and (f) are not meant to represent absolute standstill or stop positions; in reality, the thread tensioner 3 passes through these positions at a greatly reduced speed.

Figure 2:
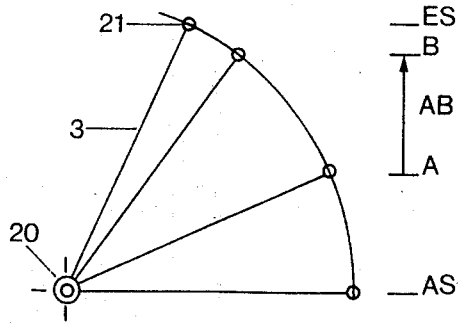
FIG. 2 shows some distinct angular positions of the thread tensioner during the tensioning operation.
Figure 3:
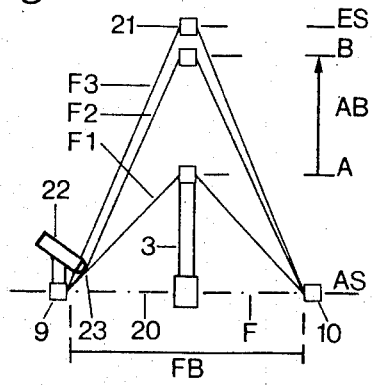
FIGS. 3 and 4 show the arrangement of a tactile thread sensor and thread tensioner in the positions according to FIG. 1, including the associated paths of the weft thread, in front and plan view, respectively.
Figure 4:
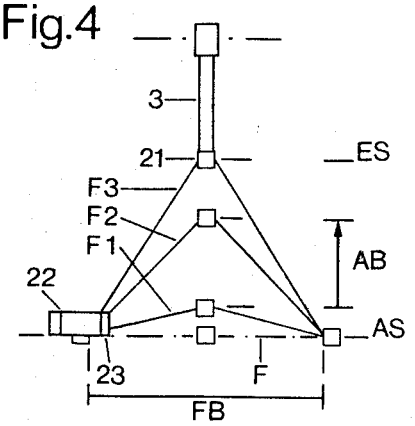

With reference to FIGS. 2, 3 and 4, the thread tensioner 3 comprises a lever mounted on a pivot axis 20 and provided with a ring-shaped thread guide 21 at its free end which moves along a cyclic guide path. It may be noted that such a tensioner arrangement is not compulsory; there might alternatively be provided a thread tensioner guiding the thread guide along a linear or other curved path.

FIG. 2 illustrates the course of the upward movement of the thread tensioner 3 while the thread guide 21 describes an arc of a circle between a lower position AS and an upper or idle position ES. The weft thread is sensed in a vertical sensing range AB between the positions AS and ES.

Sensing range AB is not absolutely fixed, however should be optimally set dependent upon the construction and operational conditions of the weaving machine and while observing the following. It is assumed that a tactile sensing device is to be used, for instance, a piezoelectrical, triboelectrical, magnetoelectrical or electrodynamical sensor may be provided as is known in this technology. Such devices respond to frictional contact with a thread under a certain stress or tension.

When thread tensioner 3 starts its upward movement from the lower position AS, the weft thread F has not yet imparted thereto sufficient tension or stress. Only after the weft thread F has been tensioned does the sensing begin at point A, and terminates at as late as possible point B at the end of the tensioning process and prior to the thread tensioner 3 reaching the upper position ES.

As now will be explained with reference to FIGS. 3 and 4, the sensing range AB may be found by correctly positioning the sensing device 22. The arrangement thereof, as shown in these Figures, on the left side of the thread tensioner 3 and above the thread guide eye 9 is particularly advantageous; firstly, there exists at this point a relatively great stress in the thread being tensioned, and secondly, the sensing device 22 may easily be mounted nearby the thread guide eye 9, for instance at its holder or the like.

As shown in FIGS. 3 and 4, in the lower position AS the section or portion F of the weft thread extending between the thread guide eyes 9,10 is straightened and is not in contact with the sensing device 22. The latter is shaped as a substantially flat box and is provided at its lower right edge with a linear friction element 23 destined for guiding and contacting the thread. In the position A, the slightly deflected thread section F1 has just come into contact with the friction element 23, such that the sensing process begins and continues during further movement upward into position B. The thread section F2 has been illustrated in FIG. 3 as having been moved upwards and in FIG. 4 as having been moved in backward direction along linear friction element 23. Upon further upward movement of thread tensioner 3, the thread releases from the friction element 23 and finally occupies a position F3 with the thread tensioner 3 in the upper or idle position. Just as in FIG. 2, here also the vertical sensing range AB between points A and B, in FIGS. 3 and 4, is marked by an upright arrow. The entire horizontal range FB of the thread tensioner 3 between the thread guide eyes 9 and 10 is principally available for mounting a thread sensor in a similar manner as shown for thread sensing device 22 mounted near thread guide eye 9.

Supposing weft thread F is correctly inserted into the weaving shed at the end of the pick: now when thread tensioner 3 moves upward between points A and B, the tensioned weft thread between positions F1 and F2 sweeps or wipes over the friction or contact element 23 of sensing device 22, such that a sensing signal is produced. This sensing signal arises independently of the above mentioned pull-after motion in longitudinal direction of the weft thread which is used in the initially mentioned known weft stop motion, since the inventive tensioning phase monitor the transverse sweep or movement of the thread when tensioned causes formation of the sensing signal. However, when the weft thread breaks, there is no thread tension in the range of the sensing device 22 during the tensioning process such that no sensing signal is produced.

The novel tensioning phase monitor has the advantage that the weft thread is in frictional contact with the sensing device 22 only during the short tensioning process. Thus, false or spurious signals which may be caused with conventional weft insertion monitors mounted on multicolour projectile machines by resting threads are avoided. Such false signals are of importance when all the sensing devices (such as sensors 22b–22e shown in FIG. 8) are connected to a common signal circuit (such as circuit 40-2). In the event of breakage of the inserted weft thread, such false signals may simulate an orderly weft insertion.

Figure 5:
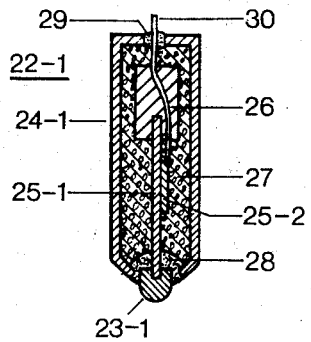
FIG. 5 shows a tactile piezoelectrical thread sensor in cross-sectional view.

With reference to FIG. 5, a piezoelectrical sensing device or head 22-1 comprises a linear friction element 23-1 which corresponds to the friction element 23, FIGS. 3 and 4, a casing 24-1 shaped as a substantially rectangular box, a vibratable lamella or thin plate 25-1 made from metal, such as spring steel, a fixedly thereto attached flat rectangular piezoelectrical element 25-2, a heavy block 26 at which lamella 25-1 is rigidly mounted, a soft bearing material 27 such as rubber sponge, an elastic sealing material 28, an insert plug 29, and an ouput line connected to piezoelectrical element 25-2 and passing through insert plug 29.

Piezoelectrical and other tactile sensing heads are known, and such known devices may be constructively adapted for use in the inventive tensioning phase monitor. However it should be taken into account that the outer shape of the casing and friction element are designed such that the weft thread when tensioned smoothly comes into contact with the friction element. In the present case, with the sensing heads 22-1 and 22-2 shown in FIGS. 5 and 6, this objective is realized by the downwardly tapered casings 24-1 and 24-2 and the friction elements 23-1 and 23-2 being linear or straight and having a half-rounded cross-section, and distinctly extending from the casing 24-1 or 24-2, respectively.

Figure 6:
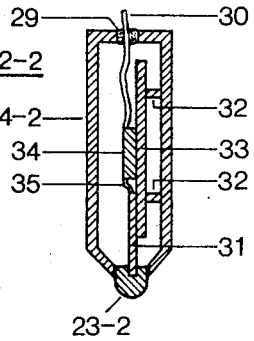
FIG. 6 illustrates a tactile triboelectrical thread sensor in cross-sectional view.

The triboelectrical sensing head 22-2, FIG. 6, comprises, in addition to the aforementioned components, an insert 29 and an output line 30, an electrode lamella or thin plate 31 fixedly connected with the friction element 23-2, a print plate 33 formed of insulating material mounted in casing 24-2 by means of a support 32, and a pre-amplifier 34, e.g. a field-effect transistor mounted on print plate or printed circuit board 33. Electrode lamella 31 is fixed or cemented to print plate 33, and connected with the input of pre-amplifier 34 through a connecting wire 34.

Figure 7:
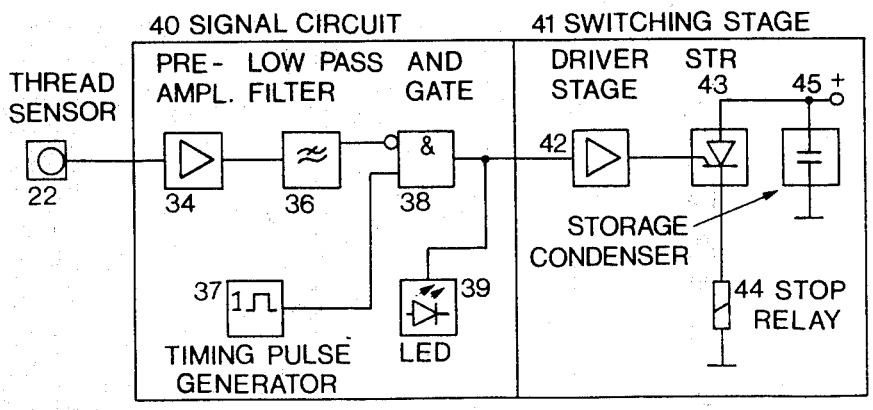
FIG. 7 is a block circuit diagram illustrating the essential electronic circuits of the inventive weft stop motion.

Fundamental instructions and teachings concerning the structure and function of piezoelectrical and triboelectrical sensing heads have been disclosed, for instance, in U.S. Pat. Nos. 4,110,654 and 3,676,769, respectively, to which reference may be had and the disclosure of which is incorporated herein by reference. FIG. 7 illustrates, by way of example, the arrangement of a tensioning phase monitor comprising a single sensing device 22, and thereto serially connected a signal circuit 40 and switching stage 41.

Signal circuit 40 comprises a pre-amplifier 34 and lowpass filter 36 serially connected to sensing device 22, a clock generator 37, e.g. monoflop, controlled by the weaving machine, an AND-gate 38 having a first negated input and a second input, and an indicator, e.g. LED 39, connected to AND-gate 38. The AND-gate 38 produces a signal indicative of yarn breakage only when there appears no sensing signal during the existence of a clock or timing pulse produced by clock generator 37. In this event, LED 39 is energized and the weaving machine is stopped by switching stage 41.

Switching stage 41 comprises a driver stage 42, a normally blocked controllable rectifier or SCR 43, a storage condenser or capacitor 45 in parallel with SCR 43, and a stop relay 44 connected in series with SCR 43. During operation, the storage condenser or capacitor 45 normally is electrically charged; upon appearance of a thread rupture or breakage signal the controllable rectifier 43 is unlocked or rendered conductive and storage condenser 45 discharged through stop relay 44 which places the weaving machine out of operation.

The block schematic diagram of FIG. 7 in generalized form also pertains to a weft stop motion which monitors the weft insertion rather than the tensioning phase. However, with such a weft insertion monitor the sensing device 22 is located at another place on the weaving machine, e.g. in the straight thread path as shown in FIG. 1(*a*) downstream of guide eye 10 and immediately in advance of thread feeder 2. In addition, clock generator 37 is controlled such as to furnish a clock or timing pulse only within the duration of the weft insertion ending with the position of projectile 1 illustrated in FIG. 1(*c*). Moreover, the signal circuit 40 and, in particular, the switching stage 41 may be arranged as shown in FIG. 7. A weft thread monitor of this type is described in copending U.S. application Ser. No. 06/111,771, filed Jan. 14, 1980, to which reference may be had and the disclosure of which is incorporated herein by reference.

A projectile or gripper shuttle weaving machine provided with a weft insertion monitor of the aforementioned type may, in addition, easily be fitted with an inventive tensioning phase monitor as now will be explained with reference to FIG. 8.

Figure 8:
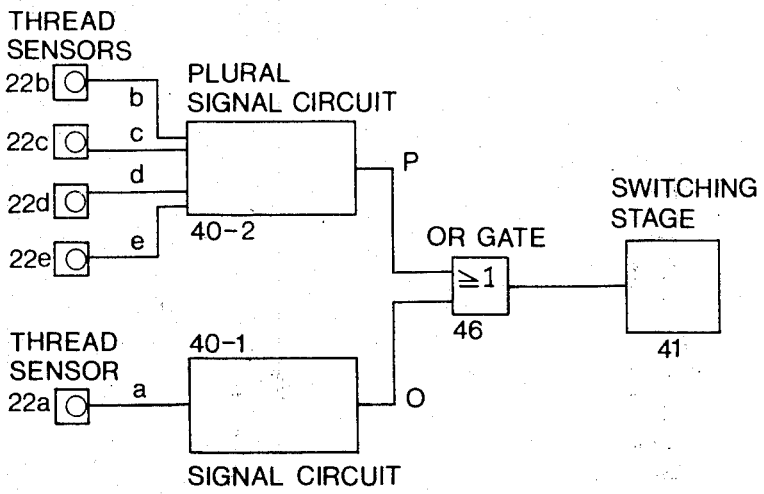
FIG. 8 is a block circuit diagram of a conventional electronic weft insertion monitor combined with an inventive weft stop motion comprising a plurality of thread sensors.

FIG. 8 illustrates a combined weft insertion and tensioning phase monitor to be used on a four-colour projectile weaving machine in block schematic representation. The weft insertion monitor comprises a sensing device 22a connected to the input a of a signal circuit 40-1, and a switching stage 41. Here, only a single sensing device 22a is necessary, which is located in a straight thread path following four tensioning devices (not shown) of the weaving machine.

The additional tensioning phase monitor requires four sensing devices 22b through 22e, a plural signal circuit 40-2 having four inputs b,c,d,e, and an OR-gate arranged between the outputs O,P of signal circuits 40-1 and 40-2, respectively, and the input of switching stage 41, for decoupling said signal circuits. It is obvious that switching stage 41 is common to the components 22a and 40-1 of the weft insertion monitor as well as the components 22b–22e, 42-2 of the tensioning phase monitor.

The tensioning phase monitor as described in the foregoing disclosure has, relative to the initially described known weft stop motion monitoring the pull-after motion, the advantage of a safe and practically inertialess indication of weft breakages and, in particular, insertion faults occurring at the end of the projectile flight.

In comparison with conventional weft insertion monitors the novel tensioning phase monitor is superior in detecting even such insertion faults occurring at the end of the projectile flight. Moreover, when used on multicolour projectile weaving machines, the tensioning phase monitor in addition affords the above mentioned benefit that no false signals caused by resting or idle threads can occur. Such false or spurious signals may be easily produced when thin and thick threads are alternately inserted and impede the machine to be stopped upon breakage of the inserted weft thread. In this event, faulty fabric is produced. Such shortcoming is avoided when using the novel tensioning phase monitor.

While there are shown and described present preferred embodiments of the invention, it is to be distinctly understood that the invention is not limited thereto but may be otherwise variously embodied and practiced within the scope of the following claims.

Accordingly, what we claim is:

1. In combination with a gripper shuttle weaving machine provided with a shuttle picking device, shuttle catching means including shuttle braking and resetting means, thread tensioning means in advance of the shuttle picking device for laterally deflecting the weft yarn during the action of the shuttle resetting means, an electronic weft stop motion which comprises:

tactile thread sensing means located at the region of the thread tensioning means such as to be frictionally contacted by the tensioned weft yarn only upon the lateral deflection thereof for furnishing an electrical thread sensing signal indicative of correct weft insertion; and an electronic signal circuit connected to the tactile thread sensing means for producing a signal stopping the weaving machine in the absence of any thread sensing signal during the lateral deflecting of the weft yarn.

2. The electronic weft stop motion as defined in claim 1, wherein the tactile thread sensing means is arranged such as to be frictionally contacted by the tensioned weft yarn only within a restricted range of the lateral deflection of the thread tensioning means.

3. The electronic weft stop motion as defined in claim 1, wherein the tactile thread sensing means comprises a piezoelectrical thread sensor provided with a substantially linear friction element.

4. The electronic weft stop motion as defined in claim 1, wherein the tactile thread sensing means comprises a triboelectrical thread sensor provided with a substantially linear friction element.

* * * * *